United States Patent [19]

Gugel

[11] 3,954,136

[45] May 4, 1976

[54] PRESSURIZED-WATER REACTOR STEAM GENERATOR HEAT-EXCHANGER TUBE ACCESS SYSTEM

[75] Inventor: Georg Gugel, Kalchreuth, Germany

[73] Assignee: Siemens Aktiengesellschaft, Munich, Germany

[22] Filed: Mar. 25, 1974

[21] Appl. No.: 454,543

[30] Foreign Application Priority Data

Mar. 30, 1973 Germany ..... 2316074

[52] U.S. Cl. ..... 165/11; 165/76; 122/364; 138/97

[51] Int. Cl. ..... F28f 11/00

[58] Field of Search ..... 122/364; 165/11, 95, 165/76, 78; 138/89, 97; 29/421 E

[56] References Cited

UNITED STATES PATENTS

| | | | |
|---|---|---|---|
| 571,016 | 11/1896 | Pratt | 122/364 |
| 3,467,175 | 9/1969 | O'Connor | 165/11 |
| 3,782,180 | 1/1974 | Harris | 165/11 X |
| 3,804,126 | 4/1974 | Haferer | 138/89 |

*Primary Examiner*—Albert W. Davis, Jr.
*Attorney, Agent, or Firm*—Kenyon & Kenyon Reilly Carr & Chapin

[57] ABSTRACT

A pressurized-water steam generator of the U-shaped tube bundle type, has its primary header provided with a horizontal pipe which extends through the header's wall and curves upwardly, rotation of the pipe permitting the upwardly curved inner end to register with any of the inlet ends of a distributor having outer or upper ends which register with the tubes of the tube bundle. The horizontal pipe can be moved longitudinally to move the distributor from one row of tubes to another, rotation of the pipe permitting registration with any of the tubes via the distributor. With this system a flexible tube inspection or repair tool carrier may be pushed through the horizontal pipe from the outside of the header and guided to any of the heat-exchanger tubes via the distributor, avoiding the need for a workman to enter the header to register the flexible carrier with the end of the tube to be inspected or repaired. The usual flexible carrier comprises a rubber rod or hose having an end for carrying an inspection or repair device, the carrier being capable of being pushed and pulled through the heat-exchanger tube and having adequate flexibility for its purpose.

4 Claims, 2 Drawing Figures

PRESSURIZED-WATER REACTOR STEAM GENERATOR HEAT-EXCHANGER TUBE ACCESS SYSTEM

BACKGROUND OF THE INVENTION

A pressurized-water reactor steam generator typically comprises a vertical housing having a feed-water inlet and a steam outlet, the lower portion of the housing being closed by a horizontal tube sheet in which the vertical legs of an inverted U-shaped heat-exchanger tube bundle are mounted. A hemispherical chamber or primary header below the tube sheet provides inlet and outlet manifolds for the inlet and outlet legs of the tube bundle, and via inlet and outlet connections places the tube bundle in circuit with the main coolant loop of the reactor pressure vessel containing the reactor core. The pressurized-water coolant goes through the primary header and the tube bundle from and to the reactor pressure vessel. Water, introduced via the feed-water inlet, rises around the tube bundle and produces steam which leaves via the generator housing's outlet, representing useful power.

The reactor core is made of assemblies of fuel rods. These rods comprise metal casings containing the nuclear fuel, and if the casing of any one of the rods leaks even slightly, the pressurized-water coolant becomes radioactive, and since the coolant is the primary medium circulated through the steam generator, the latter's primary header becomes radioactive during a normal run of the reactor. Such a condition is to be expected even though the pressurized-water coolant is continuously treated via the usual reactor auxiliary system.

As long as the heat-exchanger tube bundle of the steam generator is free from leaks, there is a complete separation of the pressurized-water coolant which circulates through the reactor core, and the feed water and output steam, so that the use of the steam as power is free from any radiation hazards.

To assure the integrity of the tube bundle of the steam generator, its tubes are inspected regularly, and if a defective tube in the tube bundle is found, the tube is put out of service by an explosive plug. The tube inspection device, such as an ultrasonic probe, for example, and if necessary, the tool which comprises ordinarily an explosively expanded plug, are attached to the end of a carrier in the form of a long flexible rod or tube or hose, which may be made of rubber, for example. With the device to be used on the end of the carrier, it is inserted in the tube to be inspected or repaired, the carrier being used to push the device in use up through the tube involved.

Both the inlet and outlet manifold portions of the primary header are provided with manholes which, when opened, permit a workman to enter and insert the device to be used on the end of the carrier, the carrier then being pushed and pulled through the tube involved as required. This possibly subjects the workman to a radiation hazard which it is very desirable to avoid.

SUMMARY OF THE INVENTION

Using either the inlet or outlet manifold sections of the primary header as an example, a horizontal pipe is installed through the wall of the header so that it can be moved both longitudinally and rotatively while sealed against leakage, as for example by using a suitable stuffing box. The inside end of this pipe curves upwardly with a radius permitting passage of the inspection and repair device carrier rod or tube. A distributor is fixed to the inner end of this pipe, the distributor comprising an array of guide tube extensions rotatively connected to the pipe's inner end and having upwardly pointing open ends interspaced to respectively register simultaneously with a plurality of the tube sheet holes in which the tube bundle legs are mounted and which, of course, open through the bottom side of the tube sheet. This array of tube extensions has downwardly pointing open ends defining an arc with which the curved pipe's inner end can register selectively by rotation of the horizontal pipe from the outside of the generator's header.

With this system, without entering the header, a workman outside of the header can feed the carrier rod or tube through the horizontal tube extending through the header's wall, and by moving the tube longitudinally, move the distributor from one row of tube sheet holes to another, rotation of the horizontal tube permitting feeding of the carrier to any one of the tube sheet holes of each row.

During reactor operation, the outside end of the horizontal tube may be closed pressure-tight by a suitable valve which, when open, permits passage of the carrier. The horizontal tube sheet and the upper portion of the hemispherical header, form a corner into which the horizontal tube and its distributor can be pulled to an out-of-the-way position. This corner may be provided with walls forming what is, in effect, a container into which the horizontal tube with its curved end and distributor can be nested, the distributor mounting a closure plate for closing this container. In this way, the pressurized-water coolant is diverted from the inside portions of the new system, during normal reactor operation with the steam generator in service.

BRIEF DESCRIPTION OF THE DRAWINGS

The preferred mode of carrying out the invention is schematically illustrated by the accompanying drawings, in which.

DETAILED DESCRIPTION OF THE INVENTION

Figure 1:
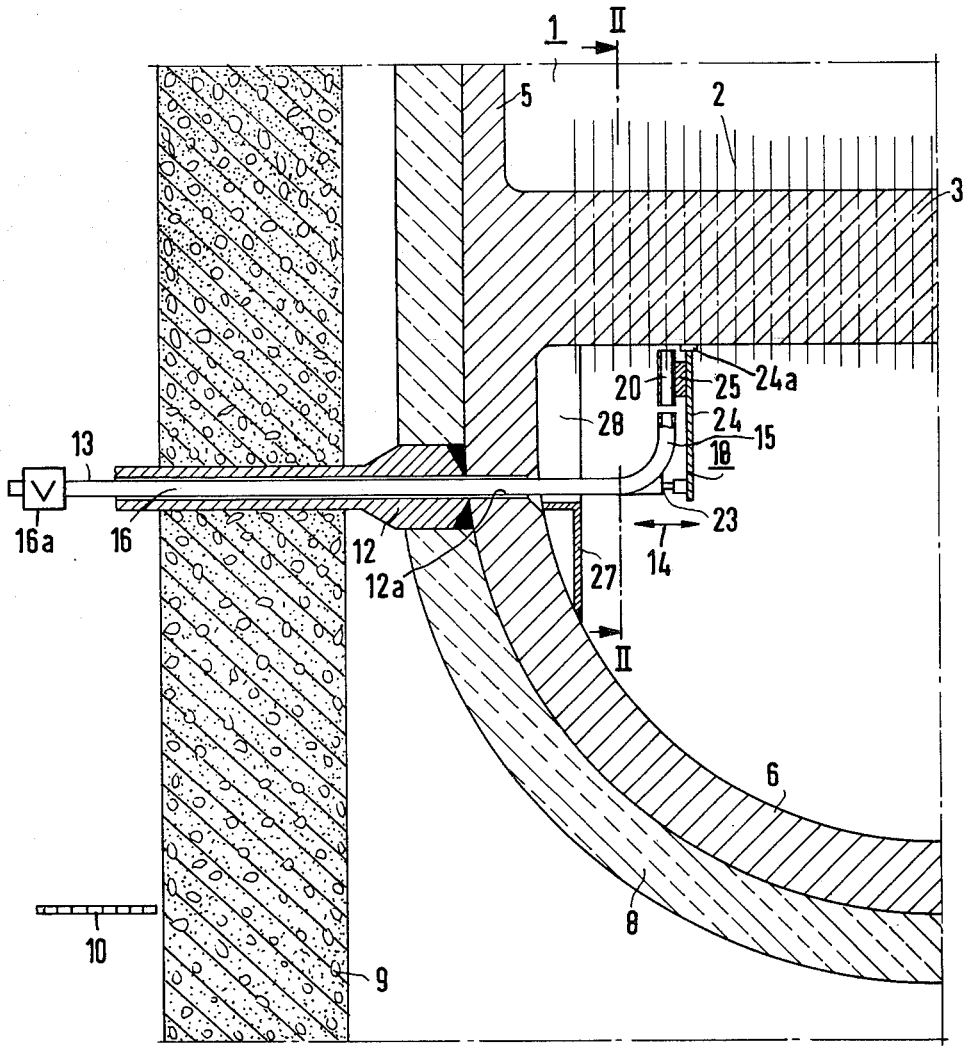
FIG. 1 is a vertical longitudinal section of a lower half portion of the steam generator incorporating the new system.

Referring to these drawings, the inverted U-shaped tube bundle, vertical leg tubes 2 are indicated by broken lines, mounted in the horizontal tube sheet 3, the tube bundle extending upwardly in the vertical cylindrical housing 5 and the bottom of the tube sheet having the primary header 6 in the form of a hemispherical chamber, the outside of the steam generator being provided with thermal insulation 8. The portion shown by FIGS. 1 and 2 could be either the inlet or outlet manifold section. The main loop connection and the manhole, previously referred to, are not shown in the interest of simplified illustrations. The illustrated vertical concrete wall 9 is the wall of the steam generator room of a reactor building, the concrete steam generator room walls providing shielding. An operating platform for personnel extends from the outside of the wall 9.

According to the present invention, a horizontal stuffing box, shown schematically at 12, is built into the upper wall portion of the hemispherical primary header chamber wall 6, this providing a horizontal passage through this wall 6 and through which the horizontal tube 13 is extended in a pressure-tight manner so that it can be operated from the outside, as by a workman on the platform 10, with the tube 13 movable both longitudinally and rotatively, the longitudinal motion being indicated by the arrow 14. The inner end of the tube 13 is curved through a 90° arc to form an inner short leg 15 extending at right angles to the long horizontal leg 16 in the stuffing box 12.

Figure 2:
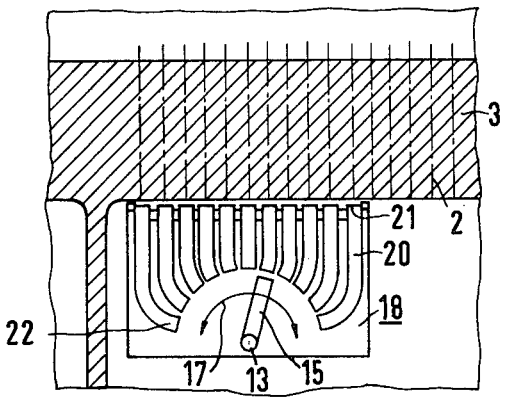
FIG. 2 is a vertical section taken on the line II—II in FIG. 1.

Referring now to FIG. 2 in particular, the tube rotation is indicated by the arrow 17. It is here that the distributor 18 is positioned, this distributor comprising a multiplicity of short tube extensions or an array of guide tube extensions 20 having upper ends 21 facing and adjacent to the tube sheet 3. These upper ends are matched to the tube pitch of the tube sheet 3 and, of course, the legs 2. The legs 2 and, therefore, the tube sheet holes, are normally positioned in rows which can be registered by the row of upper ends 21 of the array of guide tube extensions 20. Rotation of the horizontal guide tube 13 from outside of the biological shield 9, and of course, outside of the steam generator itself, serves to rotate the inner short leg 15 into registration with the lower ends 22 of the array of guide tube extensions 20, these lower ends defining an arc concentric with the axis of the horizontal portion 16 of the guide tube 13. Therefore, by moving the guide tube 13 back and forth and by its rotation, any one of a number of the tube legs 2 may be registered by one or another of the upper ends 21 of the extensions 20. All of the tube portions are curved as required for easy passage of the flexible carrier rod or hose previously described. It is unnecessary to enter the primary header 6.

As shown by FIG. 1, the distributor 18 is rotatively fastened to the rotative guide tube 16 by way of a bearing 23, a vertical plate 24 mounting the tube extensions 20 via spacers 25. The upper end of the plate 24 is provided with a bearing member 24a which rides along the bottom surface of the tube sheet 3 to maintain the correct orientation of the array of tube extensions 20, as the distributor 18 is moved from one row of tube holes to another.

When not in use and with the steam generator in service, the outer end of the horizontal guide tube 16 may be closed by a valve **16*a*** in a pressure-tight manner, using a valve which, when open, permits passage of the carrier rod or tube.

Using weld plates 27, a container or cupboard 28 is formed in the upper corner formed by the hemispherical half of the chamber 6 and the horizontal tube sheet 3. This container 28 defines what is, in effect, a door-opening, with the vertical plate 24 of the distributor 18 forming a door for this door-opening. This permits the guide tube arrangement, when not in service, to be pulled into the container 28 with the plates 27 and the flat plate 24 forming a smooth exterior, avoiding disturbance or turbulence of the primary medium or pressurized coolant, which must flow to or from the tube sheet 3 and through its tube holes. Although not shown, a remote controlled latch may be used to hold the door 24 closed, although this can also be done by maintaining an outward latched position of the tube 16.

The distributor 18 can cover only a rectangular area of the tube sheet 3, but by using other distributors operating at suitable angles relative to the one illustrated, each distributor having its horizontal tube 13, the entire underside area of the tube sheet can be covered.

The pipe 13 forms a guide tube which extends through a horizontal hole **12*a* formed in the wall of the exchanger's manifold. The stuffing box 12 is in the form of an extension of this hole 12*a* and it extends from the wall 6 through the insulation 8 and the concrete wall 9. Although the stuffing, or sealing, elements are not shown, they could be on the outside end of the part 12** where they would be accessible.

What is claimed is:

1. A pressurized-water reactor steam generator comprising a housing having a feed-water inlet and a steam outlet and an end portion, a tube sheet closing said end portion and having tube-mounting holes, a heat exchanger bundle of tubes mounted in said holes and extending from said tube sheet, said tube sheet having a bottom side through which said holes open, a chamber enclosing said bottom side, said chamber forming an outlet and/or inlet manifold for said holes, said manifold having coolant flow connections; wherein the improvement comprises a hole formed through said manifold at a level below said bottom side, and a guide tube extending through said hole and having an inner end portion, said guide tube deviating so that the inner end portion is parallel to said tubes, said inner end portion having an open end, said guide tube being movable to register said open end of said inner end portion with any of a plurality of said holes opening through said bottom side.

2. The generator of claim 1 in which said tube is rotative about its axis, and an array of guide tube extensions is rotatively connected to said inner end portion, said guide tube extensions having upwardly pointing open ends interspaced to respectively register simultaneously with a plurality of said holes opening through said bottom side and downwardly pointing open ends defining an arc and with which said open end of said curved inner end portion registers when said tube is rotated.

3. The generator of claim 2 in which said chamber is substantially hemispherical and forms a corner adjacent to said tube sheet, said tube and said array being interconnected and nesting in said corner when said horizontal guide tube is pulled outwardly from said chamber.

4. The generator of claim 3 having means for forming a container in said corner for said array with said container having an opening through which said array moves when nesting in said corner, said array having connected therewith a cover for covering said container's opening when said array is nested in said corner.

* * * * *